United States Patent [19]

Leclerc et al.

[11] 4,319,592

[45] Mar. 16, 1982

[54] PROCESS FOR THE LAYOUT OF WRAPPERS FOR CIGARS IN A HALF-LEAF OF TOBACCO

[75] Inventors: Jean-François Leclerc, Orleans; Jacques Paret, Fleury-les-Aubrais; Pierre Waegaert, Bordeaux, all of France

[73] Assignee: Service d'Exploitation Industrialle des Tabacs et des Allumettes, France

[21] Appl. No.: 118,530

[22] Filed: Feb. 4, 1980

[30] Foreign Application Priority Data

Feb. 9, 1979 [FR] France ..... 79 03287

[51] Int. Cl.[3] ..... A24C 1/04; A24C 1/00

[52] U.S. Cl. ..... 131/365; 131/280

[58] Field of Search ..... 131/20 R, 15 R, 15 C, 131/140 C, 21 R, 16, 14, 8, 280, 365; 2/243 B

[56] References Cited

U.S. PATENT DOCUMENTS 683,453 10/1901 Ertheiler et al. ..... 131/15 R

*Primary Examiner*—V. Millin

*Attorney, Agent, or Firm*—Jacobs & Jacobs

[57] ABSTRACT

A process for the layout of wrappers for cigars in a half-leaf of tobacco, of the type in which the layout plan of the wrappers is set up by disposing them one by one on the half-leaf taking into account the real contour of said leaf and its possible blemishes, the wrappers being placed tangentially with respect to one another and/or to the contour of the half-leaf and/or to the possible blemishes.

3 Claims, 4 Drawing Figures

PROCESS FOR THE LAYOUT OF WRAPPERS FOR CIGARS IN A HALF-LEAF OF TOBACCO

Figure 1:
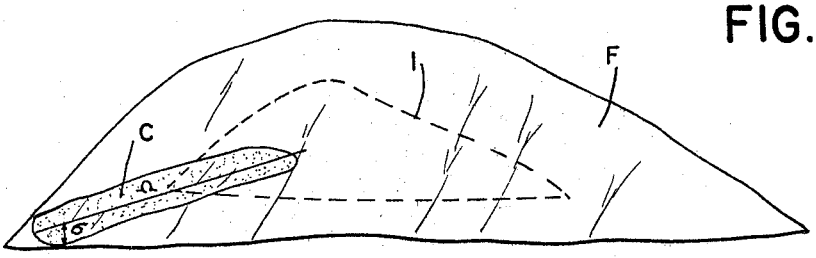

The present invention relates to a process for the lay-out of shapes of determined contour in a material of irregular surface. It relates more particularly to a process for laying out wrappers for cigars in a half-leaf of tobacco with a view to obtaining the largest possible member of unblemished wrappers. This process is applicable to the automatic manufacture of cigars in which, at one stage of the procedure, all the wrappers of a half-leaf of tobacco are cut out, simultaneously or not, after they have been laid out in said half-leaf as favourably as possible to give a maximum yield thereof, said lay-out being the purpose of the invention.

To this end, the process according to the invention envisages drawing up a layout plan by disposing the wrappers one by one on the half-leaf whilst taking into account its real contour and its possible blemishes. The wrappers are then placed tangentially to one another, tangentially to the contour and, if necessary, to the blemishes. In this way, no material is lost, as the layout of the wrappers, one by one, enables them to be disposed as favourably as possible. To concretise this process and to automatise it, this model plan must be generalised and a principle must be established which will be valid for all the half-leaves of tobacco whatever their contour and degree of wholeness.

To this end, the invention provides determining the locus of the centres of wrappers by displacing a wrapper parallel to itself, said wrapper being oriented at a given angle between the axis of the wrapper and the axis of the half-leaf, the latter axis being merged with the edge corresponding to the mid rib. The operation is renewed by adopting different values of said angle and the set of the loci of the centres is established by superposing each of the loci obtained. Then, to obtain wrappers entirely included in the half-leaf, it suffices to place their centre inside the curve which defines the set of the loci, i.e. the envelope of these loci.

The centres of the wrappers are advantageously disposed on this envelope. The wrappers thus placed are tangential to the outer contour of the half-leaf.

According to one embodiment of the invention, the barycentre of this envelope is determined and the centre of the first wrapper is placed at the point of the envelope most remote from said barycentre. This is the place for which the wrapper thus placed occupies an extreme position, thus enabling the maximum of room to be kept for the following wrappers.

Up to now, an unblemished half-leaf has been considered. According to the invention, when a half-leaf is blemished, each blemish induces therearound a zone prohibited to the centres. In fact, the centre of a wrapper placed in this zone would involve an amputation of the wrapper. The locus of the centres of the wrappers prohibited by each blemish is then determined by displacing a wrapper parallel to itself at a given angle and tangentially to the blemish.

The operation is renewed for each blemish and for each of the angles whose values succeed one another at a given increment.

For each angle, the locus of the centres of wrappers is then rectified, to take into account all the blemishes, and the rectified loci are then united to obtain the rectified set of the centres of wrappers. The contour of this set is formed by a succession of portions of contour of the rectified loci (for each angle); thus one wrapper orientation angle is generally associated with each point of the contour of rectified set. The centres of the wrappers are placed within the envelope which defines this rectified set. Any wrapper whose centre is disposed on the contour of said rectified set will either be tangential to the blemishes, or tangential to the contour of the half-leaf.

When the first wrapper has been placed as a function of the set of loci of the centres if the leaf is blemish-free or as a function of the same, but rectified set if it is blemished, the series of operations is repeated, it being considered that any placed wrapper becomes a blemish.

To this end, the locus prohibited to the centre of the second wrapper by the first is established, the loci of the centres of wrappers established for each angle are rectified, then the rectified loci for each angle are united to form a rectified set and the second wrapper is placed as a function of said rectified set. For the following wrappers, the operations are renewed until the set of the loci of the centres of wrappers corresponds to a zero set.

Thus, all the placed wrappers, their centre being within the area inscribed in the rectified set of loci, are located within the contour of the half-leaf, outside the blemishes contained in said half-leaf, and are non-secant with respect to one another. Moreover, if the centre of the placed wrappers is located on the envelope of the rectified loci after each successive lay-out, the wrappers are either tangential to the contour of the half-leaf, tangential to the blemishes or tangential with respect to one another.

The blemishes taken into account to determine the rectified locus of the centres of wrappers for a given angle of orientation are advantageously those blemishes which induce therearound a locus prohibited to the centres of the wrappers, secant with respect to the locus of the centres of the wrappers for said angle. Only such blemishes would affect the placed wrapper. If the blemish induces therearound a prohibited locus completely outside the locus of the centres of wrappers, there will be no interference with the corresponding wrapper, and the latter will be blemish-free.

The invention will be more readily understood on reading the following description with reference to the accompanying drawings, in which:

FIG. 1 shows a blemish-free half-leaf of tobacco F in which has been placed a wrapper C, the axis of this wrapper making with the mid rib an angle $\sigma$. If this wrapper C is translated parallel to itself so that it takes all the possible positions within the half-leaf, it is observed that its centre $\Omega$ follows a curve 1 which is the locus of the centres of wrappers for an orientation $\sigma$. The operation is renewed with all the possible values of the angle $\sigma$, these values succeeding one another at a given increment: for example of 5°. A series of loci is then obtained, each corresponding to an angle of orientation of the wrapper.

Figure 2:
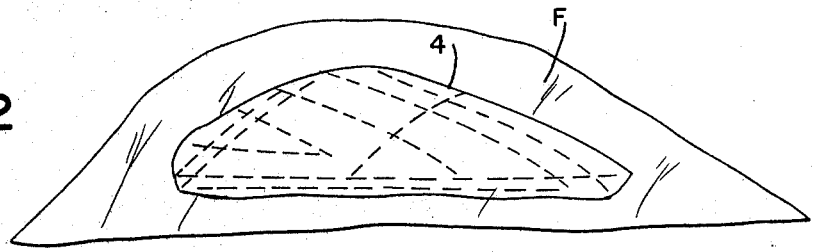

FIG. 2 shows the envelope 4 of the loci of the centres of wrappers obtained by superposing all the loci for each angle of orientation. The wrappers may therefore be placed in the half-leaf by disposing their centre within the area whose contour is defined by the envelope of the loci of the centres of wrappers. If the centre of a wrapper is placed on said contour, a wrapper will be obtained which is tangential to the contour of the half-leaf.

Figure 3:
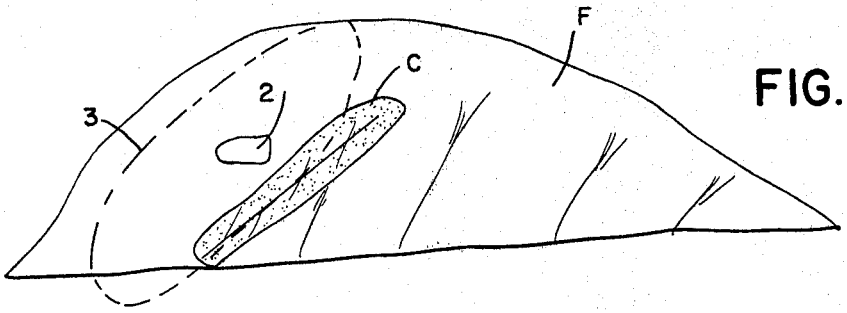

FIG. 3 shows a half-leaf of tobacco having a blemish 2. This blemish prohibits certain positions of wrappers if they are not to be covered by said blemish. The wrapper C may at the most be tangential to the blemish. By rotating this wrapper C, of angle of orientation $\sigma$, about the blemish parallel to itself and tangentially to the blemish, the locus of the centres 3 defining a prohibited area is obtained in which any centre placed therein would be the centre of a wrapper affected by the blemish. The operation is renewed for each angle of orientation $\sigma$ and for each blemish, if there are several, to constitute the set of the loci prohibited by the or each blemish.

Figure 4:
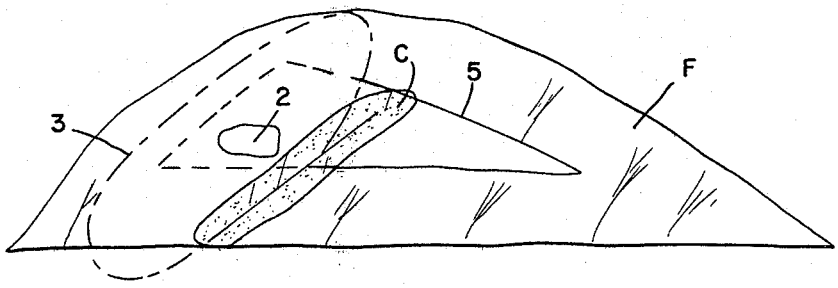

FIG. 4 shows the locus 5 rectified by subtracting from the locus 1 obtained (FIG. 1) the locus 3 prohibited by a blemish (FIG. 3). The centre of the wrapper of orientation $\sigma$ may therefore be placed in the rectified locus 5. It will be contained in the half-leaf but will not be amputated by the or each blemish.

Furthermore, for each angle $\sigma$, only those blemishes will be taken into account which induce an area prohibited to the centres of wrappers, having a common part with the locus of the centres of wrappers of orientation $\sigma$.

Then, whether or not the half-leaf is blemished and once the set of the loci of the centres of allowed wrappers is determined, it is possible to place a first wrapper, its centre being within or on the contour of said set. The wrapper which will then be placed must not interfere with this first placed wrapper. Therefore, this latter acts as a blemish with respect to the following one. After the first wrapper has been laid out, the operations must therefore be restarted in order to rectify the set of the loci as a function of the wrapper already placed. This set will be rectified again after the second wrapper, then the third, . . . has been laid out, until the rectified set no longer exists.

To place the first wrapper, and this is a particular case, after having determined the rectified set of the loci of the centres of wrappers as a function of the possible blemishes, the barycentre of this set may be sought and the centre of the first wrapper may be placed at the point of this set which is the most remote from said barycentre.

This modus operandi enables as much space as possible to be kept in the half-leaf to place the following wrappers, with a view to obtaining an optimum layout of the wrappers.

Although the example given is directed only to natural tobacco leaves, it will be readily appreciated that the process of the invention is applicable in a large number of industries and more especially those which deal with natural products having more or less random shapes and blemishes. The interest of the invention is thus obvious for the leather industries, and particularly the shoe-making industry. The transposition of the process of the invention from the cigar industry to the other industries is simply made by replacing in the preceding text and in the claims the words "leaves" and "wrappers" respectively by "flat pieces of irregular surface" and "shapes of determined contour".

What we claim is:

1. A process for the layout of wrappers for cigars in a half-leaf of tobacco, of the type in which the layout plan of the wrappers is set up by disposing them one by one on the half-leaf taking into account the real contour of said leaf and its possible blemishes, the wrappers being placed tangentially with respect to one another and/or to the contour of the half-leaf and/or to the possible blemishes, said process comprising the steps of:

(a) displacing, parallel to itself, within the half-leaf, a wrapper remaining tangential to the contour of the half-leaf and oriented so that its main axis makes with the main axis of the half-leaf a given angle $\sigma_1$, and determining the locus of the centres of this wrapper of so-called "angle of orientation $\sigma_1$";

(b) displacing, parallel to itself, within the half-leaf, a wrapper of the same orientation $\sigma_1$ but so that it remains tangential to a blemish, and determining the locus of the centres of this wrapper;

(c) rectifying the locus of the centres of the wrappers of orientation $\sigma_1$, by subtracting from the zone within this locus all the zone inside the locus determined in (b), thus obtaining a so-called "rectified locus";

(d) renewing the operations provided in (a), (b) and (c) for each of the blemishes and for each of the angles of orientation $\sigma$, so as to obtain a set of rectified loci of the centres of wrappers;

(e) determining the envelope of the set of the rectified loci, said envelope defining the zone within which the centres of the wrappers must be placed;

(f) placing a first wrapper so that its centre is within said zone defined in (e);

(g) proceeding with a second wrapper, as for the first wrapper, i.e. by carrying out operations (a) to (f) therewith and considering the first placed wrapper as being a blemish;

(h) similarly renewing the lay-out operations of the following wrappers until the set of the rectified loci defined in (d) is zero.

2. The process of claim 1, wherein the wrappers are disposed so that their centre is on the envelope defined in (e).

3. The process of claim 2, wherein the barycentre of the envelope defined in (e) is determined and the centre of the first wrapper is placed at the point of this envelope most remote from said barycentre.

* * * * *